United States Patent [19]

Levy

[11] 4,005,439

[45] Jan. 25, 1977

[54] MAGNETIC IMAGING METHOD FOR PHOTOCOPYING

[76] Inventor: Sidney Levy, 145 W. Cuthbert Blvd., Oaklyn, N.J. 08107

[22] Filed: Jan. 28, 1975

[21] Appl. No.: 544,814

[52] U.S. Cl. ..... 346/74.1; 346/160

[51] Int. Cl.[2] ..... G03G 19/00

[58] Field of Search ..... 346/74.1, 74 P; 178/6.6 A, 6.6 R; 317/124

[56] References Cited

UNITED STATES PATENTS

| | | | |
|---|---|---|---|
| 3,106,607 | 10/1963 | Newell | 346/74.1 |
| 3,778,145 | 12/1973 | McClure | 346/74.1 |
| 3,824,601 | 7/1974 | Garland et al. | 346/74.1 |

FOREIGN PATENTS OR APPLICATIONS

| | | | |
|---|---|---|---|
| 676,504 | 12/1963 | Canada | 346/74.1 |

*Primary Examiner*—Jay P. Lucas
*Attorney, Agent, or Firm*—Friedman, Goodman & Teitelbaum

[57] ABSTRACT

A magnetizable layer is initially magnetized and selected portions thereof are demagnetized by an optical imaging system. In one embodiment, an image to be reproduced is projected through a transparent electrically conductive electrode which is brought into contact with a photoconductive matrix through which is dispersed magnetizable particles. Changes in resistivity of the photoconductive matrix causes a current density distribution, which corresponds to the image intensity distribution, to flow transversely from the transparent electrode through the photoconductive matrix to a support electrode on which the matrix is fixed when a potential is applied between the transparent and support electrodes. The current distribution results in corresponding magnetic fields which modify or "erase" selected portions of the initially magnetized layer. In another embodiment, the photoconductive layer is adjacent to the magnetic layer and is disposed between two spaced electrodes arranged in a plane substantially parallel to the magnetic layer. In each case, subsequent to selected erasure, magnetic ink is applied to the remaining magnetized portions for subsequent transfer to a desired surface.

19 Claims, 15 Drawing Figures

MAGNETIC IMAGING METHOD FOR PHOTOCOPYING

BACKGROUND OF THE INVENTION

Photocopying methods typically require the use of photosensitive materials for making a weak optical image into a strong imaging energy field to produce a print. In the past, this has been done photographically using silver image chemistry or electrostatic imaging techniques using the photoconductive effect either on the print paper or on a separate drum.

The present invention deals with another method for transferring the image to copy paper. The method and apparatus to be described can reproduce an image as with prior art electrostatic imaging techniques, wherein an image carrier surface is used and the print can be made on ordinary paper, but utilizes a magnetic imaging technique which somewhat simplify the reproduction method and apparatus.

SUMMARY OF THE INVENTION

Accordingly, it is an object of the present invention to provide a new method and apparatus for transferring an image to copy paper which utilizes magnetic imaging.

It is another object of the present invention to provide a photocopying method which utilizes a magnetizable surface selected portions of which can be demagnetized by passage of a current through a photoconductive material associated with or cooperating with the magnetizable layer.

To achieve the above objects, as well as others which will become apparent hereafter, a magnetic imaging apparatus for photocopying in accordance with the present invention comprises a layer of magnetic material, selected surface portions of which may be magnetized and demagnetized upon local application of corresponding magnetic fields. A photoconductive layer is provided selected surface portions of which exhibit changes in resistivity as a function of light intensity of an image impinging thereon. A source of electrical potential is applied to the photoconductive layer to permit generation of a current density over the photoconductive layer which corresponds to an image intensity distribution impinging on the photoconductive layer, the current density generating a magnetic field having a distribution over the photoconductive layer which corresponds to the current density distribution. The photoconductive layer is proximate to or forms part of the layer of magnetic material. In this manner, selected portions of the magnetizable layer may be magnetized and demagnetized by the magnetic field. A magnetic ink supply is provided for imparting magnetic ink to the magnetic layer at the magnetized portions thereof and means are provided for transferring the ink from the magnetic layer to a surface onto which the image is to be reproduced. The invention is also directed to the method for reproducing an image by the above suggested imaging apparatus.

BRIEF DESCRIPTION OF THE DRAWINGS

With the above and additional advantages in view, as will hereinafter appear, this invention comprises the devices, combinations and arrangements of parts hereinafter described by way of example and illustrated in the accompanying drawings of a preferred embodiment in which.

Figure 1:
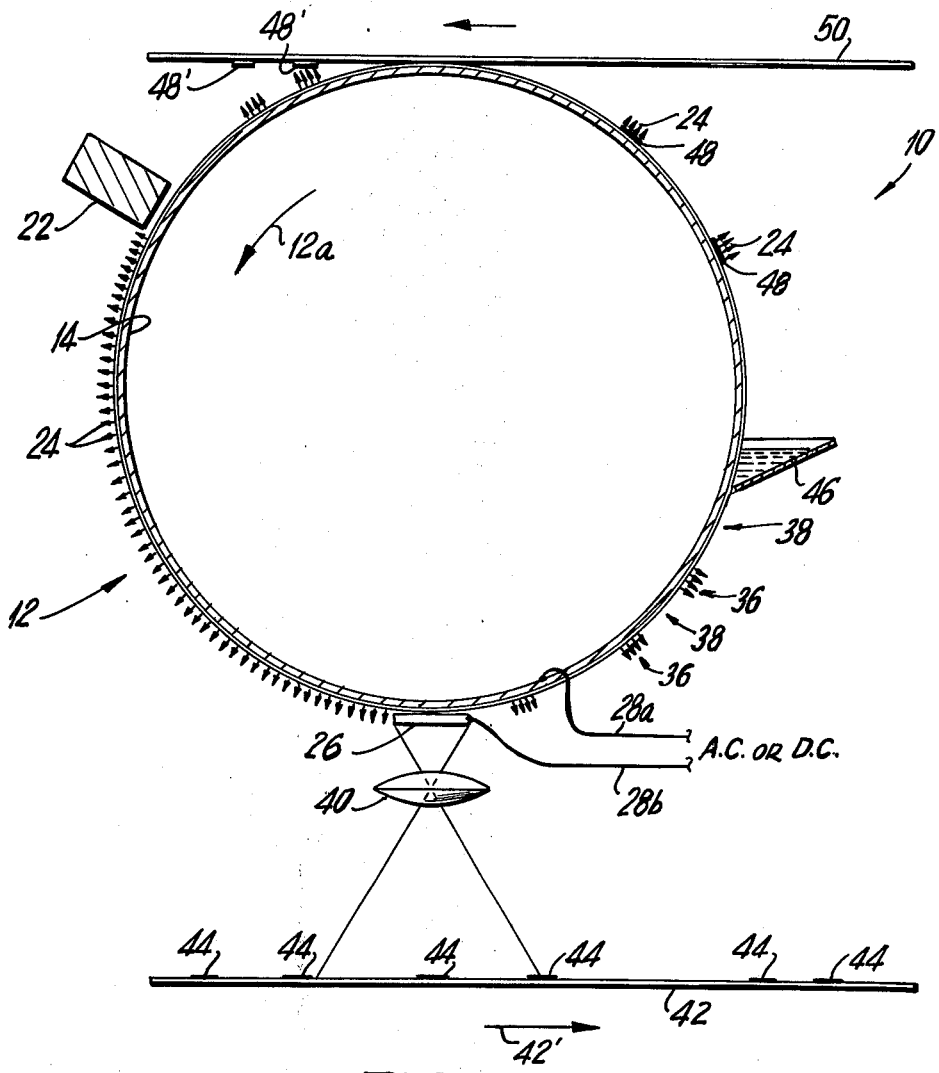
FIG. 1 is a schematic representation of a cylindrical drum provided with a magnetizable surface layer in accordance with the present invention, and showing fixed stations about the circumference of the rotatably mounted drum including a magnet which initially magnetizes the surface layer, an optical imaging device which focuses an image onto a photoconductive material for permitting current flow proximate to the magnetizable layer for demagnetizing selected portions thereof, a magnetic ink supply, and a point where the applied ink is transferred to a desired surface.
Figure 3:
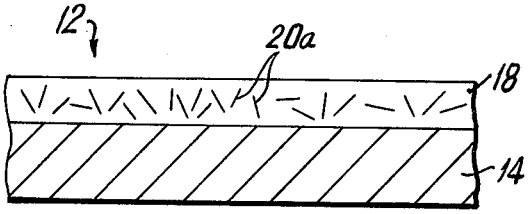
FIG. 3 is similar to FIG. 2, but schematically showing the magnetic particles randomly oriented in the demagnetized condition of the magnetic layer.
Figure 6:
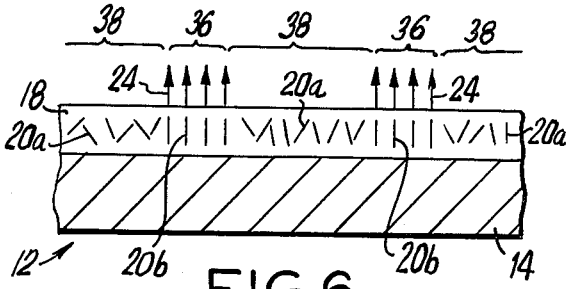
Figure 4:
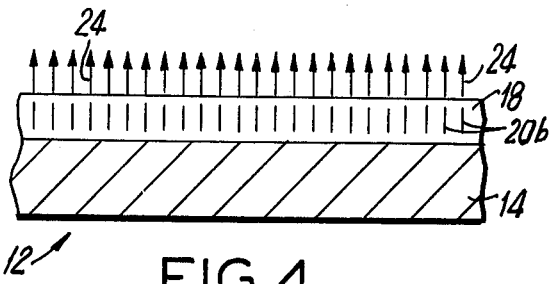
FIG. 4 is similar to FIG. 3, but showing the magnetic particles aligned to produce a magnetized condition of the photoconductive matrix, and also showing the magnetic lines of force which result from such alignment of particles.
Figure 7:
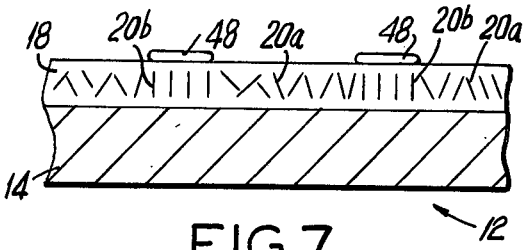
Figure 5:
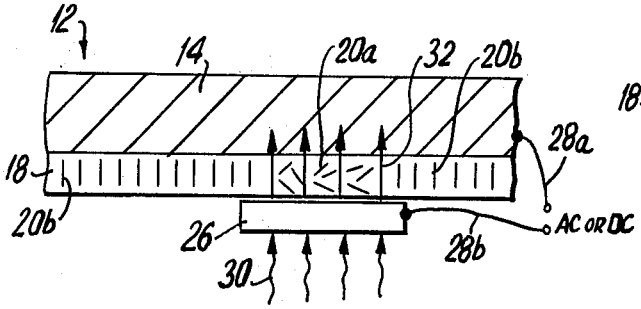
FIG. 5 is similar to FIG. 4, but further showing a transparent electrically conductive electrode which is brought into contact with a selected portion of the photoconductive matrix and an electrical potential applied between the support and transparent electrodes for producing a current distribution which corresponds to the distribution of image intensities which are transmitted through the transparent electrode at the matrix.
Figure 8:
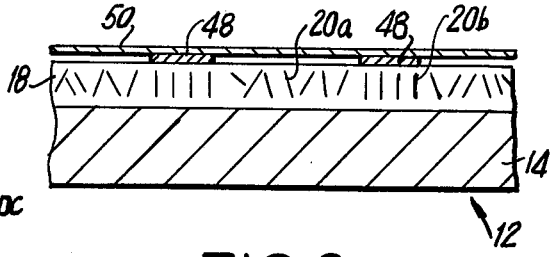
Figure 9:
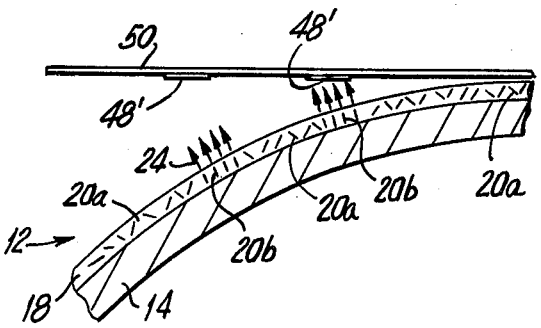
Figure 10:
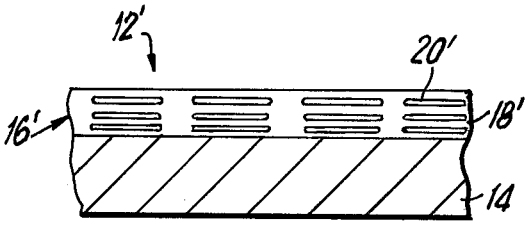
Figure 11:
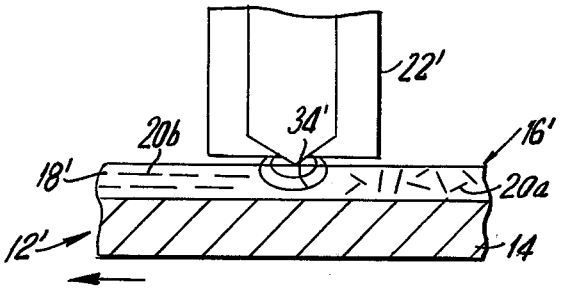
Figure 12:
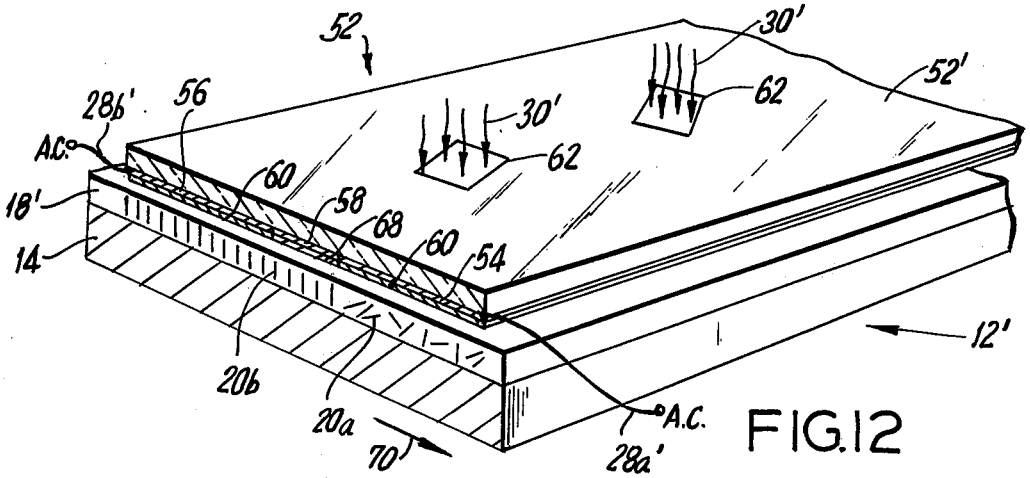
Figure 13:
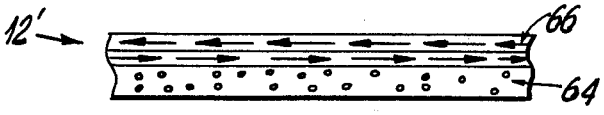
Figure 14:
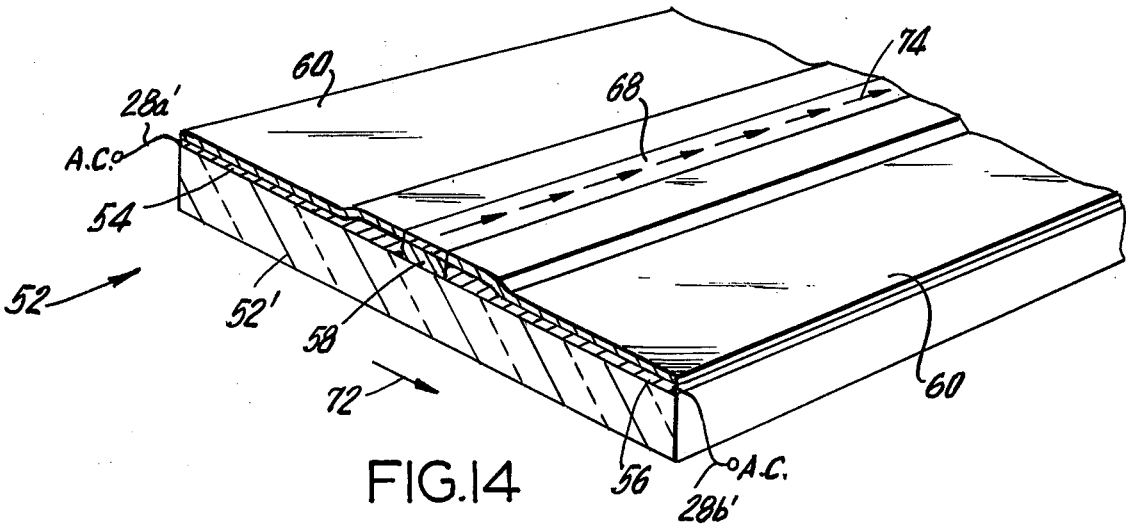

FIG. *5a* is a plan view of the arrangement shown in FIG. 5, further schematically showing the manner in which the transverse current flow through the photoconductive matrix generates magnetic fields in the plane of the photoconductive matrix;

FIG. 6 is similar to FIGS. 3 and 4, showing selectively demagnetized portions of the magnetizable surface, as suggested in FIG. 1 beyond the optical imaging apparatus or station;

FIG. 7 is similar to FIG. 6, further showing the deposition of magnetic ink on those portions of the magnetizable surface which remain magnetized;

FIG. 8 is similar to FIG. 7 and further shows the matrix surface being brought to bear against a surface onto which the image is to be reproduced;

FIG. 9 is a schematic representation of the drum subsequent to transferring the image onto the desired surface but prior to re-magnetization thereof or "erasure" of the transferred image as suggested in FIG. 1 for another cycle or revolution of the drum;

FIG. 10 is similar to FIG. 3, but wherein the magnetizable particles are embedded and dispersed through an electrically non-conductive matrix;

FIG. 11 illustrates the manner in which an electromagnet can produce a magnetic field for the purpose of magnetizing the magnetizable particles shown in FIG. 10;

FIG. 12 is a perspective view, in cross section, of a second embodiment in accordance with the present invention, wherein spaced electrodes are positioned in a plane substantially parallel to a magnetic layer and a photoconductive material is provided in the gap between the spaced electrodes to permit the flow of current density in a direction substantially parallel to the magnetic layer for the purpose of demagnetizing selected portions of the initially magnetized magnetic surface;

FIG. 13 is a fragmented cross section of a portion of the magnetic layer of FIG. 10, showing the magnetic fields therein when light is directed at the photoconductive layer; and FIG. 14 is a perspective view of a presently preferred construction of the second embodiment shown in FIG. 12.

DESCRIPTION OF THE PREFERRED EMBODIMENTS

Referring now to the FIGURES, wherein identical or similar parts are designated by the same reference numerals throughout, and first referring to FIG. 1, the reference numeral 10 refers to an apparatus for photocopying images by the magnetic imaging method in accordance with the present invention.

The photocopy apparatus or machine 10 includes a cylindrical drum 12 which is mounted for rotation about the axis thereof. However, as will become apparent hereafter, the present invention is not limited to drums and magnetic imaging as to be described may take place on a planar or other suitably configurated surface.

Figure 2:
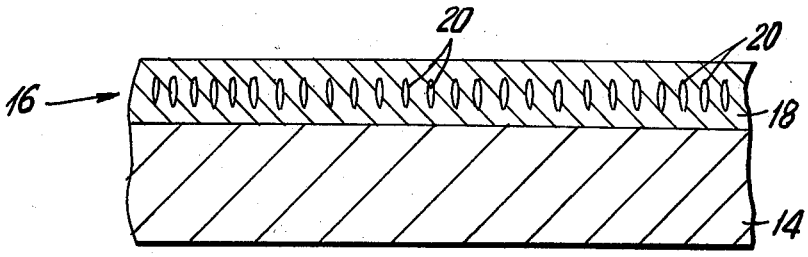
FIG. 2 is an enlarged and fragmented cross section of a portion of the cylindrical drum shown in FIG. 1, showing a photoconductive matrix in accordance with a first embodiment of the present invention in which therein embedded and dispersed a plurality of magnetizable particles, the matrix being mounted on the metallic or electrically conductive drum support electrode.

Referring to FIG. 2, a section of the drum is illustrated and includes a cylindrical preferably metallic shell 14 the exterior surface of which is coated with a magnetic or magnetizable layer 16. According to a first presently preferred embodiment, the layer 16 is in the nature of a photoconductive matrix 18 in which there is embedded and dispersed a plurality of magnetic particles 20. Suitable materials for the magnetic particles 20 include magnetic oxide such as is used in magnetic tape recordings or ferrous alloys or similar ferromagnetic materials. The matrix 18 includes a photoconductive material such as selenium, germanium, cadmium sulfide or any other of the large number of materials whose conductivity to electricity is drastically altered by exposure to light.

The magnetic material may be in the form of small isolated particles which are dispersed as suggested above. Alternately, and primarily in the use of the second embodiment to be described, the magnetic layer 16 may be in the form of a continuous magnetic metallic sheet having magnetic domains which may be oriented by external magnetic fields.

Disposed at one station proximate to the exterior surface of the magnetic drum 12, there is provided a magnet 22 which may be a permanent magnet as shown or an electromagnet. During operation, the drum 12 rotates in the direction indicated by the arrow 12*a* and the magnet 22 initially magnetizes the coating 16. When so magnetized, the initially randomly oriented magnetic domains 20*a* in FIG. 3 become aligned as indicated by 20*b* in FIG. 4 and magnetic lines of force 24 appear at the surface of the magnetic coating 16, this being shown in FIGS. 1 and 4. The magnetized condition of the layer 16 results from the alignment of the magnetic domains in the magnetic particles 20.

The method of the present invention involves demagnetization of selected portions of the magnetic coating 16 subsequent to initial magnetization by the magnet 22. The local demagnetization of magnetic layer portions is effected by the generation of current densities which correspond to the intensities of the image to be reproduced. The resulting currents, which generate associated magnetic fields in accordance with well-known principles, demagnetize the surface or coating 16 when the currents are caused to flow proximate to the magnetic coating 16.

In accordance with one presently preferred embodiment, the magnetizable layer or coating 16 is in the nature of a photoconductive matrix 18 through which the magnetizable particles are dispersed as suggested above and the shell 14 is made of a metallic or other electrically conductive material.

Figure 5A:
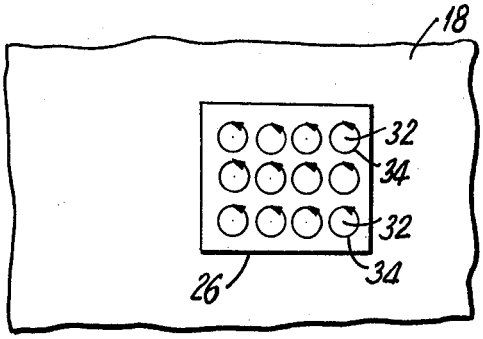

Referring to FIGS. 1, 5 and 5*a*, the first embodiment includes the use of a transparent electrically conductive electrode 26. A source of A.C. or D.C. voltage is connected by means of leads or conductors 28*a* and 28*b* to the cylindrical shell or support electrode 14, on which the magnetic coating 16 is fixed, and the transparent electrode 26. In effect, the source of potential is applied across the photoconductive matrix 18.

It will be appreciated that light 30 from an image which impinges upon the transparent electrode 26 is transmitted therethrough and impinges upon the photoconductive matrix 18. As is well known, the properties of photoconductive materials are such that they exhibit a relatively high resistance to current flow when little or no light impinges thereon. However, the resistance is drastically altered by exposure to light. Accordingly, when the light 30 impinges upon a portion of the photoconductive matrix, a current density distribution 32 is permitted to flow transversely to the matrix layer as shown, this generating magnetic fields 34 in the plane of the matrix as suggested in FIG. 5*a*. The magnetic fields 32 are generated within the photoconductive matrix 18 and these are effective to misalign the magnetic domains in the magnetic particles to random orientations as suggested by the reference numeral 20*a*. An important feature of the present invention is that the above described generation of current density over the photoconductive layer corresponds to the image intensity distribution which impinges on the photoconductive layer and the resulting current density generates a corresponding magnetic field which has a distribution over the photoconductive layer which corresponds to the current density distribution. Accordingly, only those portions of the drum surface which are exposed to light intensity from the image are demagnetized to degrees which correspond with the specific intensities at the various portions of the surface.

Referring to FIG. 6, the surface of the magnetic drum 12 is indicated as including magnetized surface portions 36 and demagnetized surface portions 38. The magnetized portions 36 are those which have remained as originally magnetized by the magnet 22 while the demagnetized portions are those which were demagnetized at the optical imaging station as described above.

The optical imaging arrangement includes a lens 40 which focuses an original copy 42 on which information 44 is imprinted onto the drum 12 surface. The information 44 from the copy 42 is focused onto the transparent electrode 26. With the arrangement shown, only a portion of the original copy 42 will be projected at the transparent electrodes 26. By movement of the original copy 42 in the direction 42′ as shown, with simultaneous rotation of the drums 12 in the direction 12*a*, the entire original copy can be projected onto the entire drum 12 surface. Suitable means, not shown, may be utilized for synchronizing the rotation of the drum 12 wth the forward movement of the original copy 42.

Subsequent to being magnetized by the magnet 22 and being selectively demagnetized at the optical imaging station (at the lens 40), the surface of the drum next passes through a magnetic ink reservoir 46 which is adapted to dispense magnetic ink in a conventional manner. The ink is attracted to and adheres to the remaining magnetic portions 36 of the coating 16. The ink which has adhered to the remaining magnetic portions is designated by the reference numeral 48 in FIGS. 1 and 7, it being noted that those surface portions 38 of the drum surface which have been demagnetized do not similarly attract the ink.

Referring to FIGS. 1 and 8, a sheet of planar material 50, such as a sheet of paper, is advanced to come into contact with the drum 12 surface as the drum rotates to thereby cause the ink 48 to be transferred onto the desired surface, this being designated by the reference numerals 48′ in FIGS. 1 and 9.

The operation of the apparatus shown in FIGS. 1–9 will now, to the extent which it has not be described above, be set forth. The surface of the drum 12, namely the magnetizable coating 16, is initially magnetized by passing the drum surface proximate to a strong magnet 22. To reproduce an image, selected surface portions of the drum 12 are demagnetized so that the magnetic ink may be applied to the remaining magnetized portions. In the embodiment being described, the image to be reproduced is effectively placed on the drum surface by a suitable optical system 40 at a place where there is a transparent conductive layer or electrode 26 maintained in contact with the drum 12 and, more specifically, in contact with the magnetizable coating or layer 16.

Since the coating or layer 16 is in the nature of a photoconductive matrix, the layer normally exhibits a high resistance to current flow when little or no light impinges on the layer. Consequently, when an A.C. or a D.C. potential or voltage is applied between the transparent electrodes 26 and the metallic conductive support electrode 14, there is little or no current flow between the transparent and support electrodes in a direction generally transverse or normal to the coating 16. However, when light is directed at the photoconductive matrix 18 through the transparent electrode 26, a current will pass through the surface layer 16 normal to the surface of the drum. The resulting current density or distribution, whether alternating or direct current, produces a circular magnetic field in the plane of the drum surface that will demagnetize selected particles or portions of the magnetic material in the photoconductive matrix. The pattern of demagnetization corresponds to the distribution of light intensity which impinges on the corresponding surface portions of the drum.

The magnetized areas 36, wherein the magnetic domains 20*b* remain aligned or oriented in parallel directions, are passed through the ink reservoir 46 containing magnetic ink which contains a ferromagnetic material capable of being attracted to and held by the magnetic fields 24 on the drum. The magnetized areas 36 will thus pick up ink and effectively reproduce the information 44 on the copy 42 on the surface of the drum 12. The image 48 on the drum is brought to bear against a sheet of paper or other desired surface 50 onto which the ink is transferred. Such transfer normally takes place by capillary action.

What has been described up to this point is the reproduction process during one complete cycle of the drum 12 which permits copying of a complete original 42. To reproduce a second original, the drum is again rotated a full revolution in synchronism with the advancing original 42 and the advancing sheet of paper 50 onto which the copy is to be reproduced. The drum surface, subsequent to contact with the sheet of paper 50, is moved proximate to the strong magnet 22 for the purpose of re-magnetizing the same. This effectively "erases" the original image which was characterized by the partially demagnetized portions on the drum 12 subsequent to passage past the optical imaging system 40. In effect, the magnet 22 erases the image which has just been transferred to the desired surface 50 in a manner similar to that used in erasing information from a magnetic recording tape. When new information 44 is imaged onto the surface of the drum 12, new portions of the now fully magnetized surface of the drum will again become demagnetized as described above for reproducing the next image.

It is important to note that the copy is "offset" by the process so that the copy 50 reads normally after printing. It should be further noted that the preferred embodiment as shown indicates demagnetization by having the current pass normally through the photoconductive surface or matrix 18. Neither of these is an essential condition for the carrying out of the present invention. The magnetic field can have other orientations such as parallel to the surface, as to be described in connection with FIGS. 10–14, and the electrical current can in such instance flow in an appropriate direction to demagnetize the material.

Both A.C. and D.C. fields can be applied across the matrix layer 18 although A.C. fields have been found to be more effective and generally more conveniently available. In addition, A.C. fields can be capacitively coupled to the photoconductive surface which would make the arrangement more durable since rubbing contact between the transparent electrode 26 and the drum 12 coating 16 would not be required in this instance.

For the large number of materials available, particularly magnetic and photoconductive materials, it should be possible to use 110 volts alternating house voltage for the source of electrical potential to establish the field to be applied to the surface of the drum 12.

The inks which can be used with the present invention can be liquid, preferably, or can be dry ink. Additionally, the ink can be any desired color by coating the magnetic particles in the ink with a suitably colored coating or by adding color to the liquid phase in the case of liquid inks.

The electrical conductivity of the photoconductive matrix 18 is a function of the light intensity and the demagnetization process is a statistical one depending on the amount of current generated magnetic field and on the magnetic strength of specific magnetic particles. Consequently, the process is one where the amount of ink pick up will be varied by the initial light intensity variations to permit continuous tone printing which is essentially photographic in nature.

Referring now to FIGS. 10–14, there is shown a further embodiment of the present invention which similarly uses the magnetic imaging technique for transferring an image by use of magnetic ink. In this embodiment, the directions of the magnetic fields which are used to produce the image are changed and the photoconductive material is removed from the drum or belt imaging surface and is used as a separate element.

In FIG. 10, a segment of the cylindrical drum 12' is shown to be coated with a matrix 18' through which are dispersed magnetic particles 20'. However, the matrix 18' in the second embodiment need not be a photoconductive material. Advantageously, the matrix 18' is electrically non-conductive. The particles 20' may be spinel, magnetite, or finely divided ferromagnetic alloys which are magnetizable. These particles are embedded in a suitable matrix 18' to hold them to the drum or belt surface, such as in a urethane binder. Particularly in the second embodiment, where there is no necessity for electrical contact with the drum and conduction to the drum, the coating 16' may be in the nature of a continuous ferromagnetic material such as a magnetic alloy whose magnetic domains may be aligned or misaligned to provide magnetized portions thereon.

In FIG. 11, a U-shaped electromagnet 22' is shown to generate a magnetic field 34' at the gap thereof which is proximate to the magnetic coating 16'. The magnetic coating 16' on the drum or belt is in the same orientation as is used in magnetic recording with the particles arranged to be magnetized in the plane of the surface. The U-shaped magnet 22' is provided with pointed poles which are capable of inducing a strong magnetic field in the plane of the drum 12' surface. The direction of the field is in the direction of movement of the surface.

Referring to FIG. 12, a "write" device 52 is provided in the arrangement of the second embodiment which includes a transparent support plate 52' which is oriented in a plane generally tangentially to the magnetizable surface. A pair of spaced electrically conductive electrodes 54 and 56, which may be made of copper, are fixed on the support plate 52'. Photoconductive material 58 is disposed within the gap formed by the opposing edges of the two spaced electrodes 54 and 56, and not within the matrix 18' in which the magnetic particles 20' are embedded.

As with the first embodiment, the photoconductive layer 58 exhibits a high resistance to current flow when little or no light impinges thereon. However, when an A.C. or a D.C. potential is placed across the spaced electrodes 54, 56 by means of leads **28*a'* and 28*b'*, and light 33', forming images 60, passes through the transparent support plate 52' and impinges upon the photoconductive layer 58**, currents flow therethrough across the gap formed by the spaced conductors.

As opposed to earlier described transverse or radial current flow from the external electrode 26 to the drum 12, the currents in the second arrangement do not flow into the drum but flow tangentially thereto and proximate to the surface coating 16' of the drum. The magnetic "write" device 52 is positioned proximate to the drum 14 surface adjacently to the magnetizable matrix 18'. The photoconductive layer 58 may be in the form of a narrow strip of a photoconductor such as selenium, cadmium sulfide or germanium which extends across the entire axial length of the drum or width of a belt. The A.C. demagnetizing current is carried to the photoconductive layer 58 by copper layers or electrodes 54, 56.

As suggested above, the magnetic field produced is transverse to the field of the magnetized surface layer 16' and in the plane of the surface. The preferred type of current is A.C. current of a suitable frequency to effectively demagnetize the magnetic particles 20'. Modulating the light level from the image increases or decreases the conductivity of the photoconductor and varies the amount of demagnetizing current carried to effectively generate the magnetic image on the drum.

As with the first embodiment, the drum moves relative to the fixed optical imaging apparatus, in the direction 70, to cause corresponding portions of the original image to be projected onto corresponding surface portions of the drum during synchronized movement of the original copy and the drum.

The basic principle of operation of the second embodiment is similar to the first. Thus, surface current densities are caused to flow proximate to the initially magnetized surface of the drum 12' to create demagnetizing fields which demagnetize selected portions of the drum to correspond with the image intensity distributions projected or directed at the drum by a suitable optical imaging system. While the currents in the first described embodiment flowed in generally radial directions from the transparent electrode 26 to the metal support electrode 14 transversely through the photoconductive matrix 18, the currents in the second embodiment are caused to flow in generally tangentially or circumferential directions along the surface of the drum 12'.

In FIG. 13, the reference numeral 64 refers to the orientation of the magnetic field of the magnetized particles on the drum surface while the reference numeral 66 designates the magnetic field produced by the current in the photoconductive layer 58.

A presently preferred construction of the second embodiment shown in FIG. 12 is illustrated in FIG. 14. The "write" device 52 includes a transparent support plate 52' through which the variable intensity light from the optical imaging apparatus can be projected at the photoconductive layer 58 to selectively cause the changes in resistivity of the layer. To improve the resolution or improve the copy quality, the gap between the spaced conductors is advantageously made small. The currents through the photoconductive material flow between the spaced conductors 54, 56 through the gap in a direction indicated by the arrow 72. To prevent loss in resolution the spaced electrodes 54 and 56 are advantageously covered by magnetic shielding material 62, such as Mu metal or nickel. The shielding layers 62 have the opposing edges thereof spaced to substantially correspond to the spacing of the spaced electrode edges to provide a narrow gap. The magnetic fields which are developed in the photoconductive layer 58 are thereby permitted to extend beyond the shielding layer 62 only in the region of the gap. Limiting the spread of the magnetic fields results in more accurate demagnetization of selected portions of the magnetic drum surface with attendant improvements in resolution.

Advantageously, an abrasion resistant coating 68 is provided above the entire surface of the photoconductive layer 58 between the shielding layers 62 to prevent damage since the element 52 may be required to essentially contact the magnetic surface for maximum effect. The layer 68 may be made from a suitable material such as urethane or silicon monoxide. The coating 68 permits magnetic fields generated by the currents through the photoconductive layer to be established above or beyond the magnetic shields 62 in the region of the gap.

The transparent support plate 52 may be made from glass or plastic. In the presently preferred construction, the spaced electrically conductive electrodes 54 and 56, the photoconductive layer 58, the shielding layers 62 as well as the abrasion resistant coating 68 are deposited on the support plate 52'. The two spaced conductors may be deposited layers of copper or other suitable metal separated by a narrow space or gap. This space has deposited on it a suitable photoconductive material such as selenium, cadmium sulfide or germanium which forms the actual photoconductive layer. The entire conductive area is then coated with a magnetic shielding material such as Mu metal except for the photoconductive area. In this way, the only currents which affect the surface of the drum are those that pass through the photoconductor. Since the resistance of the photoconductor is substantially larger than the resistance of the metal conductor, the direction of current flow will be essentially perpendicular to the line of the photoconductive material.

The "write" device 52 is passed over portions of the drum. The successive drum portions are exposed to the changing fields as the optical image causes the photoconductor layer 58 to carry more or less current depending on the intensity of the light or the image produced at the photoconductive surface by the image lens. The result is a magnetic image on the surface which retains the magnetic field in the dark areas 36 and loses the magnetic field in the light areas 38 as shown in FIGS. 1 and 6. The magnetic image on the drum is next passed through the reservoir 46 of magnetic ink as described above where the ink is deposited on the remaining magnetized drum portions 36. The ink which attracted to the drum and remains adhered thereto is transferred to the copy paper as described in connection with FIG. 1 by capillary action and contact.

It is apparent that suitable materials are available to make each element of the structure. The recording media used in magnetic recording are suitable for imaging inks which are attracted to these records are known in the prior art. The demagnetizing effects of the current is well known and suitable photoconductors are available with a range of conductance that are effective in erasing the portions of the magnetized surface portions necessary to form the image. The effect is not an on-off phenomenon so that tonal effects can be produced which will render the reproduction in a photographic tonality.

Other variations of this scheme can be envisioned where the magnetic copying can be done from transmitted picture data instead of imaging copy. It would be suitable for telecopying as well as computer printout schemes for graphical display where the magnetic image would be generated by the computer output.

The color of the image can be any suitable color which can be introduced into the magnetic inks. By sequential printing of the image through special color filters onto separate imaging units it is possible to make a color image by the method of the present invention.

While the invention has been described in both embodiments as including a movable drum and a substantially stationary optical image apparatus, it should be clear that the same results may be achieved by fixing the drum, belt or plate and moving the optical imaging apparatus relative thereto. It is only important, to achieve the objects of the present invention, that selected portions of an initially magnetized surface be demagnetized to correspond with the intensities of an image of light. In both embodiments disclosed, the demagnetization is performed by projecting the variable intensity image onto a photoconductive layer or matrix which is proximate or forms part of the magnetizable layer.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. A magnetic imaging apparatus comprising a layer of magnetic material, selected surface portions of which may be magnetized and demagnetized upon local application of corresponding magnetic fields; a photoconductive layer selected surface portions of which exhibit changes in resistivity as a function of light intensity of an image impinging thereon; a source of electrical potential applied to said photoconductive layer to permit the generation of a current density over said photoconductive layer which corresponds to an image intensity distribution impinging on said photoconductive layer, said current density generating a magnetic field having a distribution over said photoconductive layer which corresponds to said current intensity distribution, said photoconductive layer being proximate to said layer of magnetic material, whereby selected portions of said magnetizable layer may be magnetized and demagnetized by said magnetic field distribution; magnetic ink supply means for imparting magnetic ink to said magnetic layer at the magnetized portions thereof; and means for transferring said ink from said magnetic layer to a surface on which the image is to be reproduced.

2. A magnetic imaging apparatus as defined in claim 1, wherein said magnetic material and photoconductive layers together form a single layer which is in the nature of a plurality of magnetizable particles embedded in and dispersed through a photoconductive matrix.

3. A magnetic imaging apparatus as defined in claim 1, wherein said magnetic material is a ferromagnetic material.

4. A magnetic imaging apparatus as defined in claim 1, wherein said magnetic material is a magnetic oxide.

5. A magnetic imaging apparatus as defined in claim 1, wherein said magnetic material is a ferrous alloy.

6. A magnetic imaging apparatus as defined in claim 1, wherein said photoconductive layer comprises selenium.

7. A magnetic imaging apparatus as defined in claim 1, wherein said photoconductive layer comprises germanium.

8. A magnetic imaging apparatus as defined in claim 1, wherein said photoconductive layer comprises cadmium sulfide.

9. A magnetic imaging apparatus as defined in claim 1, further comprising a cylindrical drum, said layer of magnetic material being disposed about the exterior surface of said drum, said drum being mounted for rotation about the axis thereof to successively bring surface portions of said layer of magnetic material proximate to predetermined substantially fixed points disposed about the circumference of said drum.

10. A magnetic imaging apparatus as defined in claim 1, further comprising a magnet disposed proximate to said layer of magnetic material for initially magnetizing the same.

11. A magnetic imaging apparatus as defined in claim 1, further comprising optical imaging means for reproducing an original image remote from said photoconductive layer onto the same.

12. A magnetic imaging apparatus as defined in claim 11, wherein said optical imaging means includes a transparent electrically conductive electrode, and further comprising a support electrode, said photoconductive layer being fixed on said support electrode, successive portions of said photoconductive layer being movable into contacting relation with said transparent electrode, said source of electrical potential being connected to said support and transparent electrodes, whereby said current density distribution may flow between said support and transparent electrodes through said photoconductive layer and may be varied on successive portions of said photoconductive layer to form corresponding magnetic field distributions which modify the magnetized conditions of portions of said layer of magnetic material with variations of image intensity projected through said transparent electrode of said photoconductive layer.

13. A magnetic imaging apparatus as defined in claim 1, further comprising a first station proximate to said magnetic layer where an original copy to be reproduced is disposed; a second station proximate to said magnetic layer where said ink is transferred to said surface; and further comprising a magnet provided between said first and second stations for magnetizing said magnetic layer subsequent to transfer of said ink at said second station, whereby each of said portions of said layer of magnetic material are fully magnetized upon reaching said first station.

14. A magnetic imaging apparatus as defined in claim 13, wherein said layer of magnetic material and said photoconductive layer are one; and further comprising a cylindrical drum mounted for rotation about the axis thereof, said first and second stations being disposed on substantially diametrically opposite ends of said drum, and said magnet being positioned proximate to one cylindrical segment extending between said first and second stations; and said magnetic ink supply means being disposed proximate to the other segment extending between said first and second stations, whereby said current densities flowing through said photoconductive layer cause selected portions of said layer of magnetic material to become demagnetized, ink only being applied to the remaining magnetized portions on the surface of said drum for subsequent transfer to said surface at said second station.

15. A magnetic imaging method comprising the steps of a. providing a layer of magnetizable material;
b. magnetizing said magnetizable layer;
c. providing a photoconductive layer which exhibits changes in resistivity as a function of light intensity of an image impinging thereon;
d. exposing said photoconductive layer to a variable intensity image while said photoconductive layer is proximate to said magnetizable layer;
e. applying an electrical potential to said photoconductive layer to permit the flow of a current density the distribution of which corresponds to the variable intensities of the image impinging on said photoconductive layer, said current density generating magnetic demagnetizing fields coupled to said magnetizable layer which demagnetize selected portions of said magnetizable layer;
f. applying magnetic ink to the remaining magnetized portions of said magnetic layer; and
g. transferring the ink to a surface on which the image is to be reproduced.

16. A magnetic imaging method as defined in claim 15, wherein said magnetizable and photoconductive layers are one, and further comprising the step of moving successive portions of a transparent electrically conductive electrode, with said photoconductive layer disposed between said transparent electrode and a supporting electrode on which said photoconductive layer is fixed, whereby electrical currents may flow transversely between said transparent and support electrodes through said photoconductive layer to modify the magnified states of said magnetizable layer portions.

17. A magnetic imaging apparatus comprising a layer of magnetic material, selected surface portions of which may be magnetized and demagnetized upon local application of corresponding magnetic fields; means for initially magnetizing said layer of magnetic material; means for generating a magnetic demagnetizing field density distribution in the region of said layer of magnetic material which corresponds to an image intensity distribution, whereby selected portions of said magnetizable layer may be demagnetized by said magnetic field distribution; magnetic ink supply means for imparting magnetic ink to said magnetic layer at the magnetized portions thereof; and means for transferring said ink from said magnetic layer to a surface on which the image is to be reproduced.

18. A magnetic imaging apparatus comprising:

a photoconductive layer, selected portions of which exhibit changes in resistivity in a direction normal to the surfaces of the layer as a function of variations in the light intensity of an image impinging thereon;

a source of electrical potential applied across said layer for the generation of a current flow through said photoconductive layer in a direction normal thereto, said current corresponding in density and distribution to the light image intensity distribution impinging on said photoconductive layer;

said current generating a magnetic field in the plane of the layer being of a magnetic intensity distribution through said photoconductive layer which corresponds to the current density distribution;

a uniformly magnetized magnetic layer, said magnetic layer being sufficiently proximate to said photoconductive layer which magnetic intensity of selected portions of said magnetic layer may be reduced corresponding to said magnetic field intensity distribution; whereby a magnetic image corresponding to said image is established.

19. A magnetic imaging apparatus as defined in claim 18, wherein said magnetic and photoconductive layers together form a single layer which is in the nature of a plurality of magnetizable particles embedded in and dispersed through a photoconductive matrix.

* * * * *